US011680764B1

(12) United States Patent
Bray

(10) Patent No.: US 11,680,764 B1
(45) Date of Patent: Jun. 20, 2023

(54) REVERSE FLOW FIREARM SUPPRESSOR

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 17/727,585

(22) Filed: Apr. 22, 2022

(51) Int. Cl.
*F41A 21/30* (2006.01)
*F41A 21/32* (2006.01)

(52) U.S. Cl.
CPC ..... *F41A 21/30* (2013.01); *F41A 21/32* (2013.01)

(58) Field of Classification Search
CPC ..... F41A 21/30
USPC ..... 181/223
See application file for complete search history.

(56) References Cited

U.S. PATENT DOCUMENTS 7,207,258 B1 * 4/2007 Scanlon ..... F41A 21/30 89/14.4
8,286,750 B1 * 10/2012 Oliver ..... F41A 21/30 89/14.4
8,875,612 B1 * 11/2014 Klett ..... F41A 21/34 89/14.4
10,634,445 B1 * 4/2020 Klett ..... F41A 21/30
2004/0154462 A1 * 8/2004 Ang ..... F41A 21/30 89/14.2
2015/0090105 A1 4/2015 Pace
2015/0101882 A1 4/2015 Moss et al.
2015/0260473 A1 9/2015 Barney
2016/0123689 A1 5/2016 Maeda
2017/0321985 A1 * 11/2017 Bray ..... F41A 21/34
2018/0274873 A1 9/2018 Thomas
2018/0299223 A1 * 10/2018 Barrett ..... F41A 21/30
2019/0257607 A1 8/2019 Dobrinescu
2020/0109907 A1 4/2020 Klett et al.
2021/0071979 A1 * 3/2021 Plunkett, Jr. ..... F41A 21/30
2022/0163281 A1 * 5/2022 Madigan ..... F41A 21/30
2022/0276016 A1 * 9/2022 Dueck ..... F41A 21/34

OTHER PUBLICATIONS

PCT/US22/27052, "Notification of Transmittal of the International Search Report and the Written Opinion of the International Searching Authority, or the Declaration", International Searching Authority, dated Jul. 27, 2022, pp. 1-14.

* cited by examiner

*Primary Examiner* — Jeremy A Luks
(74) *Attorney, Agent, or Firm* — Kunzler Bean & Adamson

(57) ABSTRACT

An apparatus is disclosed for a firearm suppressor. In certain examples, the firearm suppressor includes an outer cylinder defining a longitudinal axis, and an inner cylinder having an inner chamber, where the inner cylinder is disposed at least partially within the outer tube and defines an outer chamber with the outer cylinder, where the outer chamber is disposed between an inner surface of the outer cylinder and an outer surface of the inner cylinder. The suppressor also includes a reversing baffle disposed at one end of the inner cylinder and configured to reverse a flow of gasses from the inner chamber and direct the gasses into the outer chamber, and at least one reverse flow pathway comprising a reverse section and a forward section, and where the at least one reverse flow pathway fluidly couples the inner chamber with an end cap.

20 Claims, 10 Drawing Sheets

REVERSE FLOW FIREARM SUPPRESSOR

FIELD

This application relates generally to firearms. In particular, this application relates to firearm sound suppressors or silencers.

BACKGROUND

Suppressor design has, for over 100 years, included the basic structure of a series of baffles and chambers which trap expanding gasses as they exit a muzzle. Though there have been many variations on this core design concept, virtually every design has followed this basic design. However, this basic design is flawed because it traps the pressure in the initial chamber and significant pressure is generated on the first baffle, commonly called the "blast baffle". This pressure and heat buildup in that first chamber creates several negative effects that include back pressure into the barrel. This back pressure often causes the firearm to malfunction from added carbon and fouling from the gasses. Additionally, over gassing the system and increasing the cyclic rate creates additional stresses on the components that lead to mechanical failures. Another negative effect of excessive backpressure is that gasses and debris are blown back into the operator's face.

Another shortcoming of the basic design is that the gasses must exit out of the small holes either back into the barrel, or forward against the base of the bullet, which can cause turbulence and accuracy issues.

Also, most basic designs do not create optimum gas expansion, diffusion and cooling, because the designs provide poor heat transfer "heat sink" capabilities. Accordingly, gas expansion is limited, and gas pressures are maintained until the bullet exits the suppressor, at which point the hot gasses finally are allowed to exit the small bore hole at relatively high pressure, velocity and heat. Pressure, velocity, and heat are the main contributors to the sound signature.

One other area that adds to the overall sound signature of these designs is that the bullets may push a supersonic cone of air ahead of the bullet and as the bullet passes through each chamber a sonic boom is created in the ambient air within each chamber and again as the bullets exit the suppressors. Another design failure of the basic design is that the ambient air contained in the chambers is ignited and results in a large flash out the end of the suppressor. Because this flash may attract the attention of an armed enemy and notify the enemy of the operator's location, this flash is known to members of the armed forces as the "bloom of death".

Additionally, to achieve the maximum amount, or level of sound reduction, suppressors typically have to increase the length, internal volume, and/or baffle structures. Longer suppressors provide for greater time and distance of bullet and gas travel, and there is a longer time frame for the gasses to exit the longer structure. However, this negatively affects weight, overall length of the firearm (making it more cumbersome), as well as increases the negative effects of backpressure.

BRIEF SUMMARY

An apparatus is disclosed for a firearm suppressor. In certain examples, the firearm suppressor includes an outer cylinder defining a longitudinal axis, and an inner cylinder having an inner chamber, where the inner cylinder is disposed at least partially within the outer tube and defines an outer chamber with the outer cylinder, where the outer chamber is disposed between an inner surface of the outer cylinder and an outer surface of the inner cylinder. The suppressor also includes a reversing baffle disposed at one end of the inner cylinder and configured to reverse a flow of gasses from the inner chamber and direct the gasses into the outer chamber, and at least one reverse flow pathway comprising a reverse section and a forward section, and where at least one reverse flow pathway fluidly couples the inner chamber with an end cap.

In certain examples, the at least one reverse flow pathway is defined by the outer surface of the inner cylinder, the inner surface of the outer cylinder, and a plurality of ridges disposed between the outer cylinder and the inner cylinder. The at least one reverse flow pathway comprises at least 4 reverse flow pathways of equal circumferential arc length, and where each of the at least 4 reverse flow pathways has a unique longitudinal length. In certain examples, each of the at least 4 reverse flow pathways is fluidly independent from each other.

In certain examples, the reverse section is substantially linear and directs the flow of gasses in a direction substantially parallel with a bore axis. The forward section is non-linear, in certain examples, and is configured to direct the flow of gasses in at least a first off-axis direction and a second off-axis direction with respect to the bore axis. The inner cylinder is configured to couple with a muzzle of a firearm.

In certain examples, the suppressor also includes a removable flow director disposed within the inner cylinder, where the flow director comprises a plurality of vanes configured to direct the flow of gasses in one of either a clockwise or a counterclockwise direction. The flow director may include a plurality of flow directors, and where the plurality of flow directors includes at least one flow director having clockwise oriented vanes positioned adjacent a flow director having counterclockwise oriented vanes. The number and spacing of the flow directors can be configured to optimize different performance attributes for a particular application.

In certain examples, the reversing baffle comprises a plurality of lobes having a concave surface configured for redirecting the flow of gasses. Also disclosed is a firearm that couples to the suppressor.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

The subject matter of the present application has been developed in response to the present state of the art, and in particular, in response to the problems and needs in the art that have not yet been fully solved by currently available firearm suppressors. Accordingly, the subject matter of the present application has been developed to provide a firearm suppressor that overcomes at least some shortcomings of the prior art.

As will be described in greater detail below, the suppressor incorporates a design that incorporates multiple pressure zones and flow paths. Structures positioned in gas flow paths create multiple flow paths that reverse a direction of gas flow, with respect to a direction of travel of a fired projectile. Additionally, the suppressor, in certain examples, eliminates first-round pop and flash that is caused by ignition of oxygen within the suppressor. These and other features and benefits will be described in greater detail below.

Figure 1A:
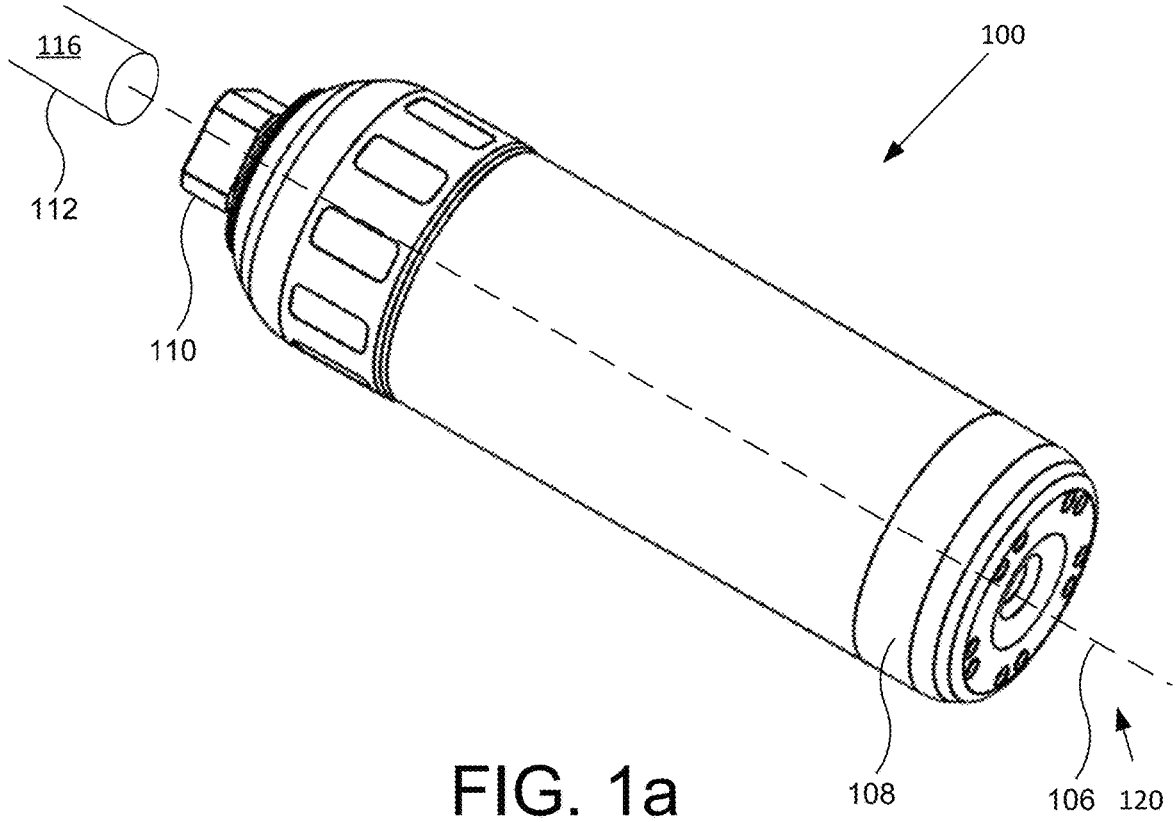
FIGS. 1*a* and 1*b* are perspective and side view diagrams, respectively, of a firearm suppressor in accordance with examples of the subject disclosure.
Figure 1B:
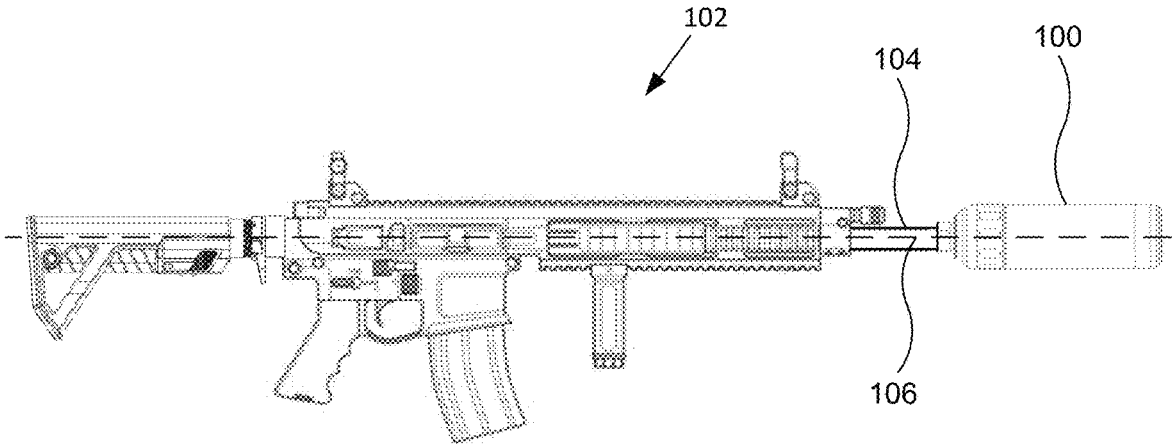

FIGS. 1*a* and 1*b* are perspective and side view diagrams, respectively, of a firearm suppressor 100 in accordance with examples of the subject disclosure. Although the below described embodiments describe the use of the suppressor 100 with a rifle 102, the components and methods described may be modified to accommodate different types of firearms, including but not limited to, pistols, etc.

The firearm suppressor 100, in the depicted example, may be used with any suitable firearm. Depicted in FIG. 1*b* is a rifle or firearm 102, for purposes of illustration only, is a variant of the M16/AR-15 family. As used herein, the terms "forward" and "front" refer to ends of mechanisms that are nearest the exit point of a projectile, or bullet. For example, the front of the firearm 102 refers to the muzzle end 104 of the firearm 102. Similarly, the "front" or "forward" portion of the firearm suppressor 100 is near the exit point of the projectile. Likewise, "rear," "rearward," correspond to ends of mechanisms that are furthest from the exit point of the projectile. The path a projectile travels through the firearm 102 and the firearm suppressor 100 is defined by the bore axis 106.

Accordingly, the firearm suppressor 100 is formed as an elongated device having a "forward" or first end 108 and a "rearward" or second end 110. The second end 110 of the firearm suppressor 100 is configured to couple with a muzzle end 104 of a barrel 112. The firearm suppressor 100 extends axially forward from the muzzle end 104 of the rifle 102 along the bore axis 106. The bore axis 106 is formed by a bore (not shown) that allows a projectile (not shown) to pass through barrel 112. The firearm suppressor 100 also includes a bore that is coaxial with the bore of the barrel 112. Accordingly, a projectile may pass through the barrel 112 and the firearm suppressor 100. In other words, the firearm suppressor 100 has an opening positioned in the second end 110 that aligns with a muzzle opening of the barrel 112 and extends the bore of the barrel 112 to an opening formed in the first end 108 of the firearm suppressor 100.

The firearm suppressor 100, as will be described in greater detail below, includes an improved internal flow design that reverses exhaust gasses into multiple flow paths of differing lengths. In certain examples, one or more of the multiple flow paths may have substantially similar lengths. The reverse flow pathways may have two segments, the reverse flow portion and the forward flow portion, or exit flow portion. The forward flow portion may contain structures that redirect and slow the gas exit timing. The reverse flow portion and forward flow portion may be of equal or unequal widths to further effect flow timing and gas pressure. For example, having a wider forward flow portion would decrease the flow pressure and velocity, which would affect the overall gas flow exit time and duration. By reversing and diverting exhaust gasses into flow paths of differing lengths or with differing gas flow restriction, the firearm suppressor 100 beneficially causes the exhaust gasses to exit the firearm suppressor 100 at different time intervals. Slowing and spreading out the escape of the exhaust gasses from the firearm suppressor 100 is beneficial in reducing sound levels, backpressure, temperature, and improving flash reduction. As used herein, the terms "reverse" and "reversing" may refer to redirecting a gas flow into an opposite direction along the bore axis 106 than a projectile travels. For example, exhaust gasses in the firearm suppressor generally travel "forward" along the bore axis. "Reversing" the exhaust gas flow may refer to redirecting the exhaust gasses in a general direction towards the rifle 102 along the bore axis 106. The components and arrangements thereof to accomplish reversing the exhaust gas flow are described below in greater detail.

Figure 2:
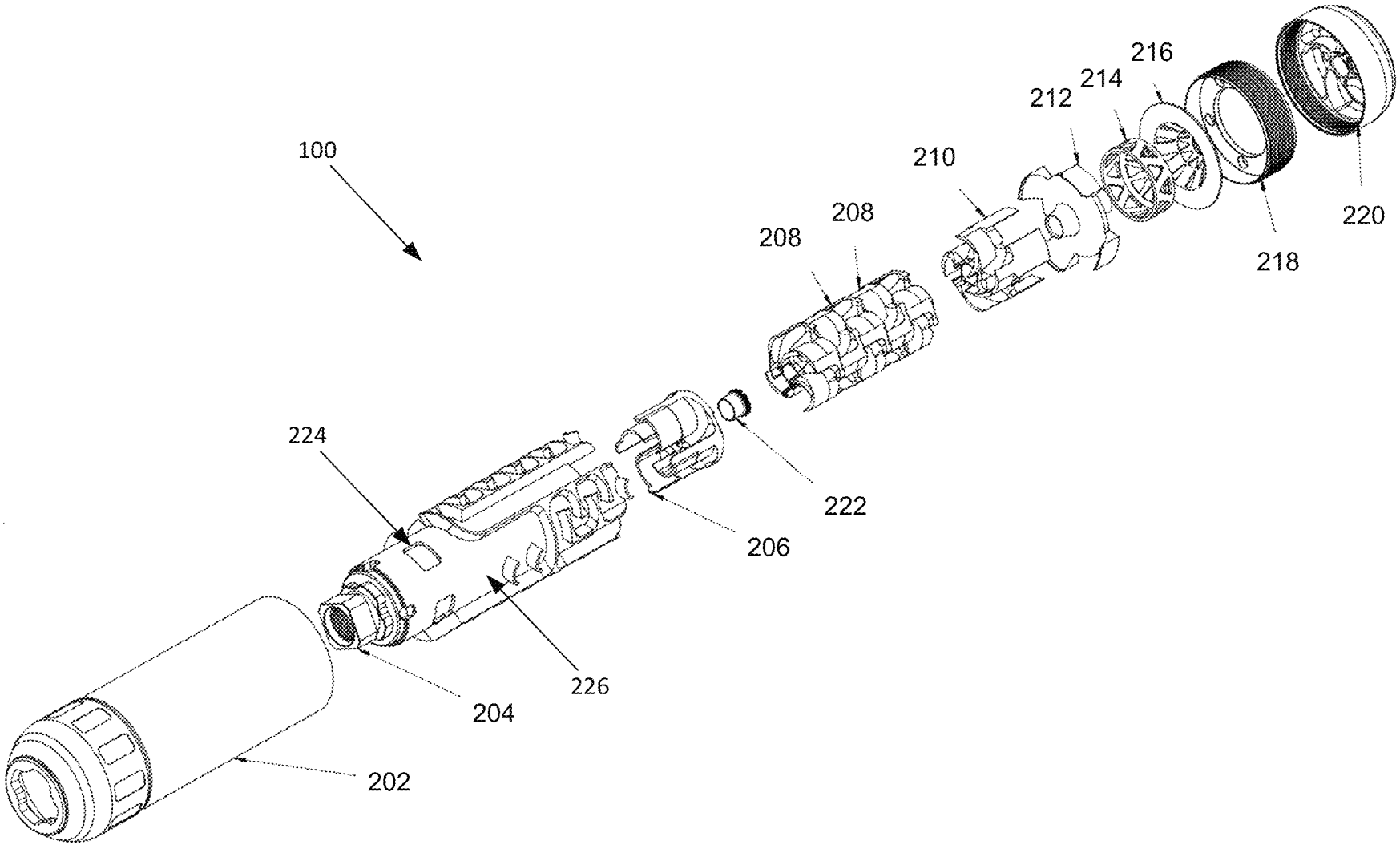
FIG. 2 is an exploded view diagram illustrating one example of the firearm suppressor, in accordance with examples of the subject disclosure.

FIG. 2 is an exploded view diagram illustrating one example of the firearm suppressor 100, in accordance with examples of the subject disclosure. The firearm suppressor 100, in the depicted embodiment, is formed of multiple individual components that may be separately manufactured and assembled to form the firearm suppressor 100. However, the firearm suppressor 100 may alternatively be manufactured as a single unitary product. It is contemplated that as 3D printing techniques improve, the firearm suppressor 100 may be manufactured by these 3D printing techniques. Generally, the components of the firearm suppressor 100 may be formed of ceramics, composites, metals, and/or metallic alloys. Different materials may be used for the different components, as it may be desirable for one component to absorb and diffuse heat, and thereby have a high coefficient of thermal conductivity, and another component to have a low coefficient of thermal conductivity.

As depicted, the suppressor 100 is formed with an outer cylinder 202, an inner cylinder 204, a base flow director 206, intermediate flow directors 208, an end flow director 210, a reversing baffle 212, a primary diffuser 214, a secondary diffuser 216, a retainer ring 218, and an end cap 220. In certain examples, the suppressor 100 also includes one or more bore inserts 222. The outer cylinder 202 forms a housing around the multiple components that will be described below in greater detail. Many of the components are formed with a passageway through which a projectile may pass. The longitudinal bore axis 106 of FIG. 1, that depicts the path of a projectile, extends through the suppressor 100.

The suppressor 100 is formed with an inlet in the outer cylinder 202 that engages the muzzle end of the barrel 112 to receive a bullet, or other high energy (i.e., high velocity) device, and an outlet in the end cap 220 through which the bullet travels. The end cap 220 also includes multiple openings for exhausting and dissipating muzzle blast, gasses, bullet shock waves, and other particulates.

In certain examples, the inner cylinder 204 has a threaded end which threads onto the muzzle of the firearm (i.e., the end of the barrel 112 of FIG. 1). Various types of standard or metric threads may be selected. In one embodiment, interrupted threads (not shown) may be utilized to implement a quick attachment method to attach the suppressor 100 to the firearm 102. Other types of quick-connect mechanisms are contemplated. In another example, the inner cylinder 204 may have flats machined or otherwise formed on the muzzle-engaging end to allow a wrench, or other tool, to apply torque to the suppressor 100 to attach it to the firearm. As used herein, the phrase "muzzle end" refers to the opening through which a bullet exits a device.

The inner cylinder 204, as will be described in greater detail below, is formed with various features extending outward from an outer surface of the inner cylinder. The features are configured and oriented to direct the flow of gasses along different flow paths. These flow paths, in certain examples, have two segments, comprised of a reverse flow that flows gasses in a generally axial direction from a distal end (furthest from the muzzle of the barrel 112) towards a proximate end (nearest the muzzle of the barrel 112) of the inner cylinder 204. An exit flow or forward flow portion flows gasses in a generally axial direction from a proximate end (closest from the muzzle end of the barrel) towards a distal end (furthest from the muzzle of the barrel 112). Stated differently, these flow paths generally direct the flow of gasses in a direction that is parallel to the bore axis 106, while crisscrossing the direction. In another example, the flow paths traverse multiple times the direction that is parallel to the bore axis 106. In certain examples, the features may be formed on an inner surface of the outer cylinder 202.

An outer chamber is formed between the outer cylinder 202 and the inner cylinder 204. The features (e.g., ridges or baffles) that are formed on the inner cylinder 204 extend from the inner cylinder 204 to the outer cylinder 202 and accordingly, the pathways formed by the features are enclosed by the outer cylinder 202 so that gasses are directed through the distinct pathways, as will be described and illustrated with regards to FIGS. 6*a*-6*d*

The flow diverters, which include the base flow director 206, the intermediate flow director 208, and the end flow director 210, are disposed within the inner cylinder 204. Each flow diverter is formed with a bore that is aligned and coaxial with the bore axis 106 so that the projectile passes through the flow diverters. Each flow diverter may be formed with vanes that cause either a clockwise or counterclockwise flow direction of gasses. In certain examples, the flow diverters alternate between clockwise and counterclockwise vanes. Beneficially, as the bullet/projectile passes from one flow diverter to an adjacent flow diverter, the venting gasses are directed outward in opposing directions (i.e., clockwise spin or counterclockwise spin) to accomplish pressure equalization and reducing gas blow by, where gasses are compressed between the bullet and inner surface of the bore of the diverters 208. Referring to the intermediate flow director 208, the gasses are directed outward and then inward as the gasses travel from one flow diverter 208 to an adjacent intermediate flow diverter until passing through the end flow director 210, reaching the reversing baffle 212 and being reversed and directed into the outer chamber between the outer cylinder 202 and the inner cylinder 204.

In certain examples, a release port 224 is formed in the inner cylinder and positioned to correspond with the base flow director 206. A small amount of gas or pressure is directed through base flow director 206 and into a backpressure reduction chamber 226. This beneficially allows for a purge of oxygen in the flow diverters to prevent ignition, pop, and excess muzzle flash.

Figure 3A:
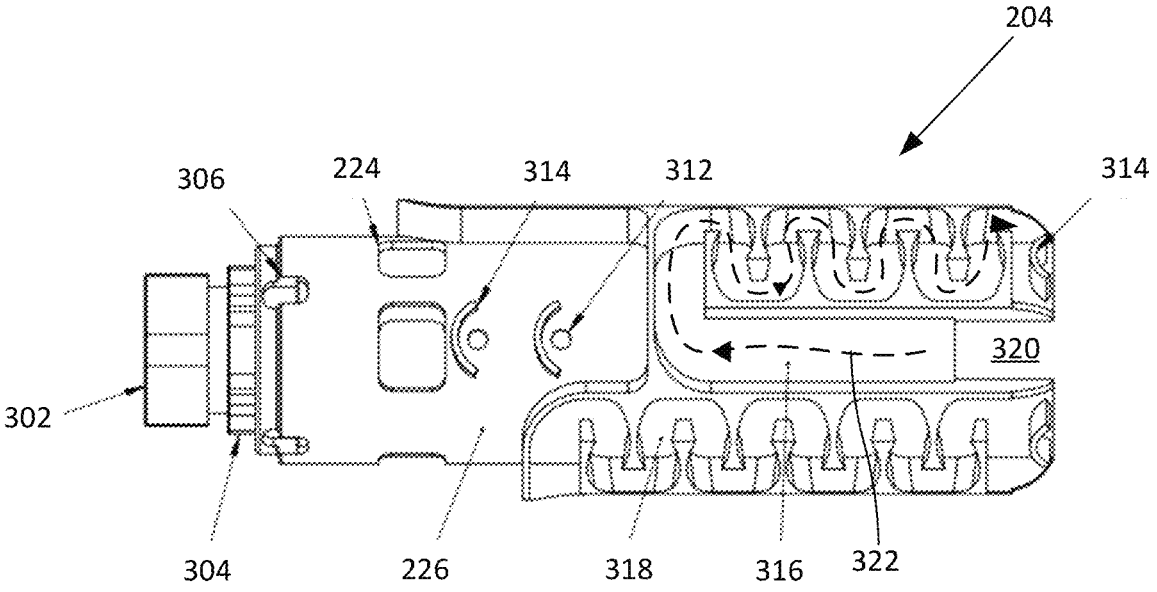
FIGS. 3*a* and 3*b* illustrate side and perspective view diagrams, respectively, of the inner cylinder, in accordance with examples of the subject disclosure.
Figure 3B:
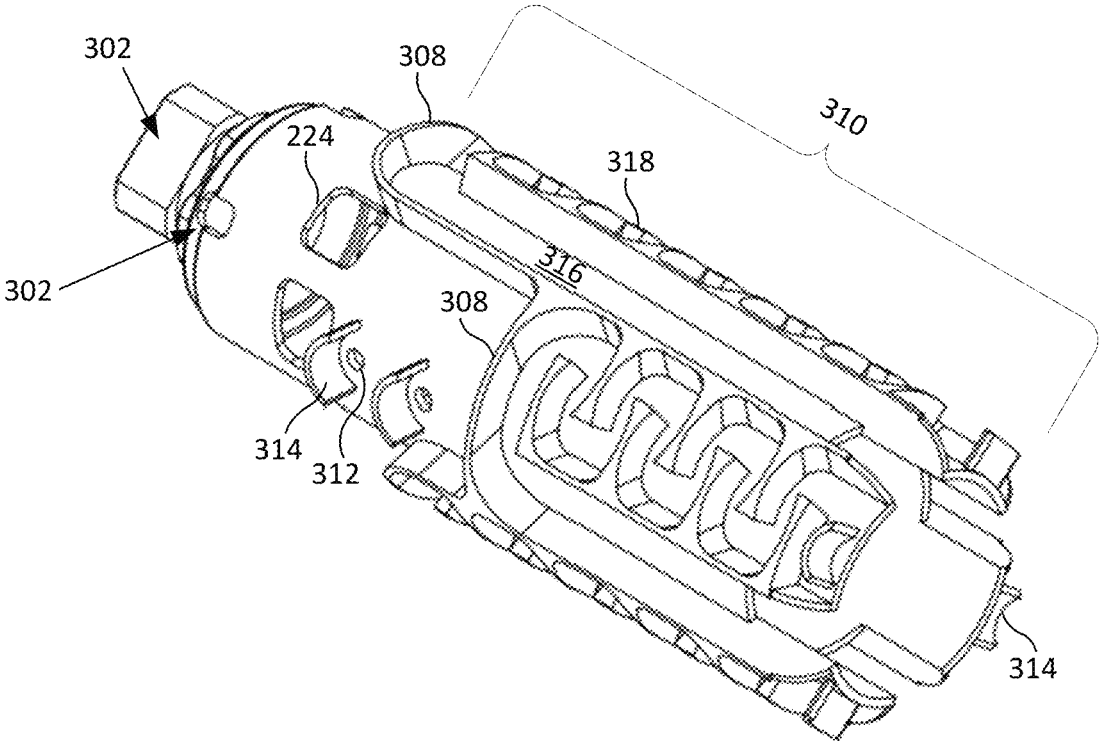
Figure 4:
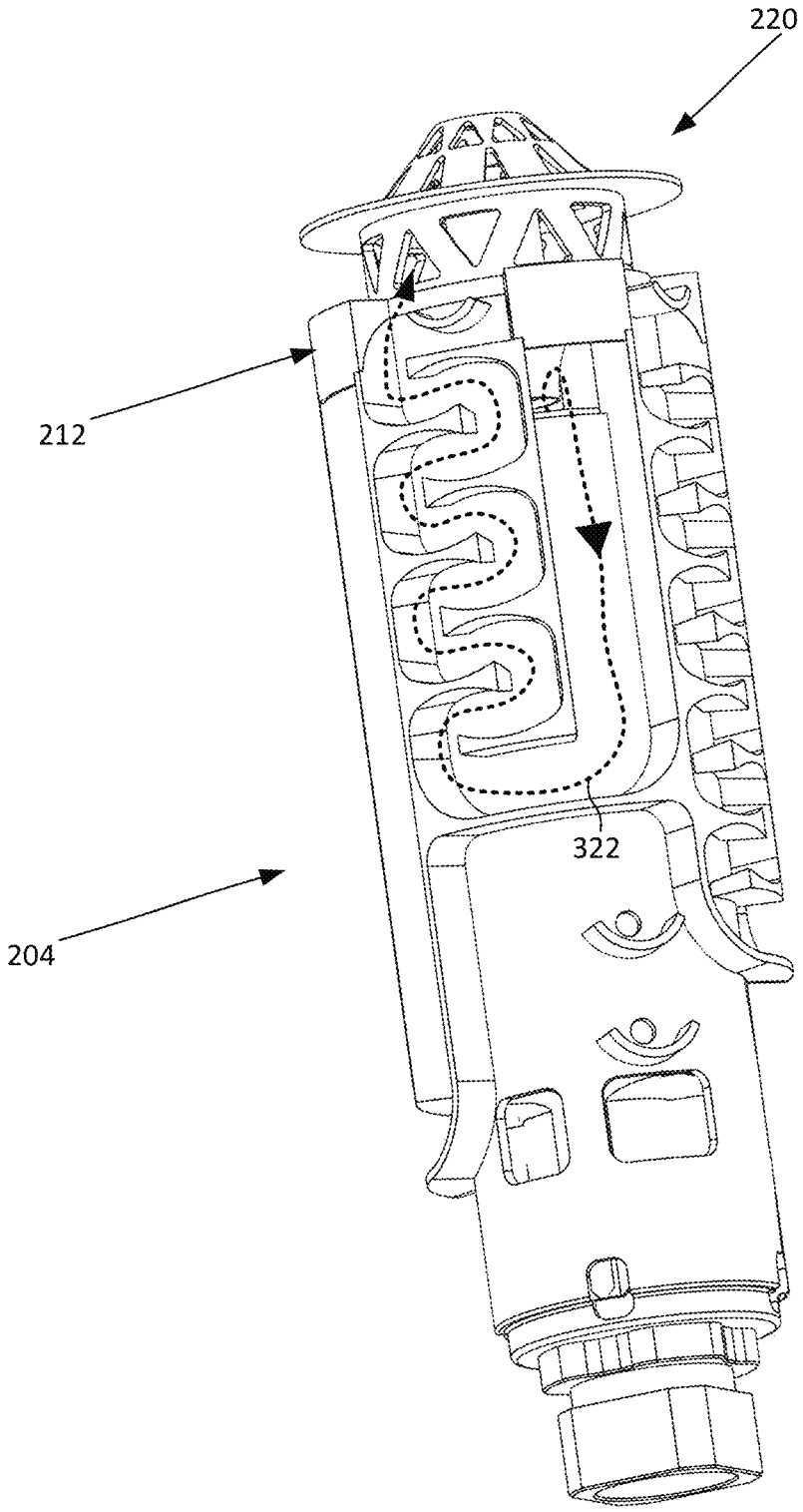
FIG. 4 is a side perspective view diagram illustrating one example of the inner cylinder coupled with the reversing baffle, primary diffuser and secondary diffuser in accordance with examples of the subject disclosures.

FIGS. 3*a* and 3*b* illustrate side and perspective view diagrams, respectively, of the inner cylinder 204, in accordance with examples of the subject disclosure. FIG. 4 is a side perspective view diagram illustrating one example of the inner cylinder 204 coupled with the reversing baffle 212, primary diffuser 214 and secondary diffuser 216 in accordance with examples of the subject disclosures. Referring now to FIGS. 3*a*, 3*b*, and 4, the outer cylinder 204 is formed with a coupling mechanism 302 for connecting the suppressor 100 with the firearm 102 of FIG. 1B. The coupling mechanism 302 may be a direct thread mechanism that is adapted to interface with a threaded barrel of the firearm 102. In other examples, the coupling mechanism 302 may be a quick-detach muzzle adapter.

In certain examples, the inner cylinder 204 is formed with a keyed shoulder interface 304 (see also FIG. 2) that engages a with a corresponding opening in the outer cylinder 202. The keyed shoulder interface 304 rotationally locks the inner cylinder 204 with respect to the outer cylinder 202. In other words, the keyed shoulder interface 304 ensures that the inner cylinder 202 does not rotate within, or with respect to, the outer cylinder 204.

The inner cylinder 204, in certain examples, includes one or more indexing notches 306 for aligning the rotational position of the base flow director 206 with respect to the inner cylinder 204. The indexing notches 306 are formed adjacent the keyed shoulder interface 304 and near the coupling mechanism 302.

In certain examples, the inner cylinder 204 includes the backpressure reduction chamber 226 that is disposed adjacent to the indexing notches 306. The backpressure reduction chamber 226 is positioned on the inner cylinder 204 to encircle the base flow director 206 when inserted into the inner cylinder 204. The backpressure reduction chamber 226 is configured to allow a pressure blowdown from the base flow director 206 and subsequently lower backpressure into the firearm 102. The backpressure reduction chamber includes one or more release ports 224 formed in the inner cylinder 204 and positioned to correspond with vanes of the base flow director 206. The release ports 224 fluidly couple an interior area of the inner cylinder 204 occupied by the base flow director 206 with the backpressure reduction chamber 226. The backpressure reduction chamber 226, in certain examples, is the area bounded by the inner cylinder 204, the outer cylinder 202, an end of the outer cylinder 202, and a ridge 308 or wall of a reverse pathway 310.

The backpressure reduction chamber 226 may also be formed with one or more purge ports 312 and gas deflectors 314. Each purge port 312 allows a small amount of gas/pressure to exit the backpressure reduction chamber 226 and enter back into an interior area of the inner cylinder 204. This beneficially allows the suppressor 100 to purge oxygen in the interior area of the inner cylinder 204 so that the oxygen is not ignited during the first fired round. This also helps to reduce muzzle flash. Additionally, the purge ports 312 help reduce backpressure into the firearm by allowing a small amount of gas to bleed out of the backpressure reduction chamber 226. Gas deflectors 314, in certain examples, are ridges that extend outward from an exterior surface of the inner cylinder 204. The gas deflectors 314 may be semi-circular in shape, as depicted, and positioned adjacent to a purge port 312. In other examples, the gas deflectors may have an angular, or v-shaped, configuration. Other shapes are contemplated. The gas deflectors 314 help reduce erosion of the purge ports 312 and deflect backflow (e.g., gas flow from an interior area of the inner cylinder 204 back into the backpressure reduction chamber 226 through one of the purge ports 312. Gas deflectors 314 may also be positioned at an end of a reverse flow pathway 316 to prevent gasses from moving from the end cap 220 back into the reverse flow pathway 316.

The reverse flow pathway 310, in certain examples includes a reverse section 316 and a forward section 318, or exit flow section. As used herein, the term "reverse section" refers to a section of a flow pathway that directs gasses in a direction that is generally opposite to the direction of travel of the projectile. Similarly, "forward section" refers to a section of a flow pathway that directs gasses in a direction towards the end cap 220. In other words, the "forward section" directs gasses in a direction that generally follows the direction of travel of the projectile, and the "reverse section" directs gasses in an opposite direction. The reverse section 316 is fluidly coupled with the interior area of the inner cylinder 204 via cutouts 320. Gasses in the interior area of the inner cylinder are directed through the cutouts 320 by the reversing baffle 212 into the reverse section 316. The general direction of fluid flow through a reverse pathway 310 is depicted by arrow 322.

In certain examples, the reverse section 316 is generally linear in configuration and the forward section 318 is configured to direct the gasses in an off-axis pathway. Stated differently, the forward section 318 defines a pathway that causes gasses to travel back and forth along the outer surface of the inner cylinder 204. The forward section 318 may be serpentine and continuous (i.e., walls or bridges that are unbroken). In other examples, the forward section 318 may include one or more gas deflectors positioned in a non-continuous manner (i.e., each gas deflector does not contact an adjacent gas deflector). In certain examples, the reverse section 316 may include off-axis (e.g., serpentine, etc.) pathways and the forward section 318 may be generally linear. As used herein, the term "serpentine" refers to a pathway that directs a gas flow in at least a first off-axis direction and a subsequent second off-axis direction.

The end cap 220 pressure zone, which is comprised of the primary diffuser 214 and secondary diffuser 216, beneficially prevents exiting gasses from recompressing and combusting unburnt propellants. Gasses from the multiple reverse flow paths 310 converge before exit at the end cap pressure zone, and the triangular shape diffuses gas flow without recompressing flows. With triangular shapes there are three edges to create more surface area contact with gasses vs. holes, which helps to slow gasses. The shape of the triangle creates different pressure areas within the gas flow which improves diffusion and turbulence. Interlaced triangular shapes provide efficient use of space. However, other geometric shapes may be implemented. A flange provides a surface for the retainer ring 218 to be tightened against to secure all the internal parts.

Figure 5:
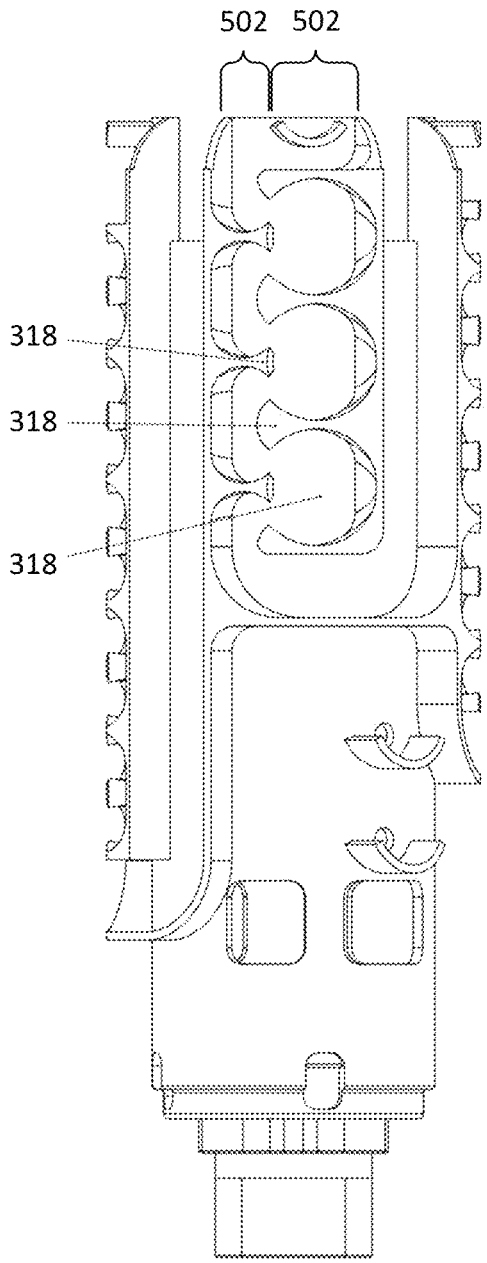
FIG. 5 is a side view diagram of another example of an inner cylinder, in accordance with examples of the subject disclosure.
Figure 6A:
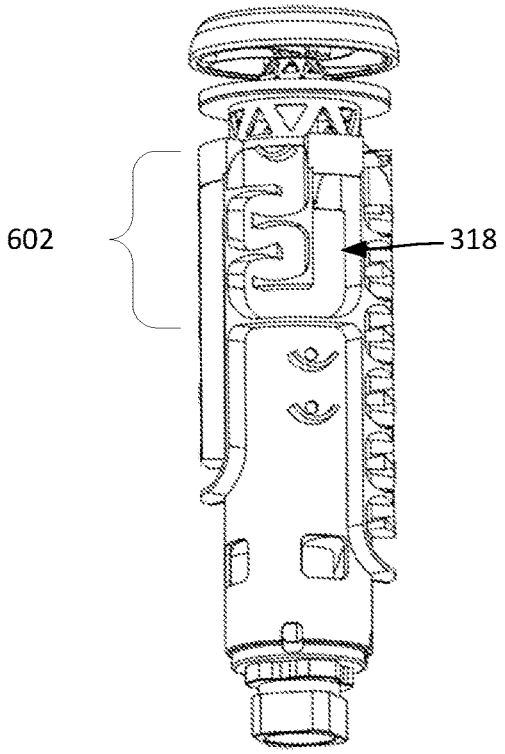
FIGS. 6*a*-6*d* are side view diagrams illustrating a reverse pathway, in accordance with examples of the subject disclosure.
Figure 6B:
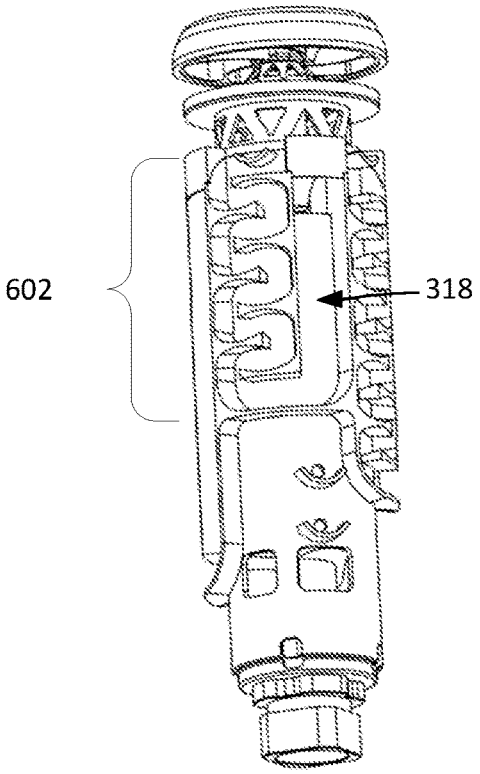
Figure 6C:
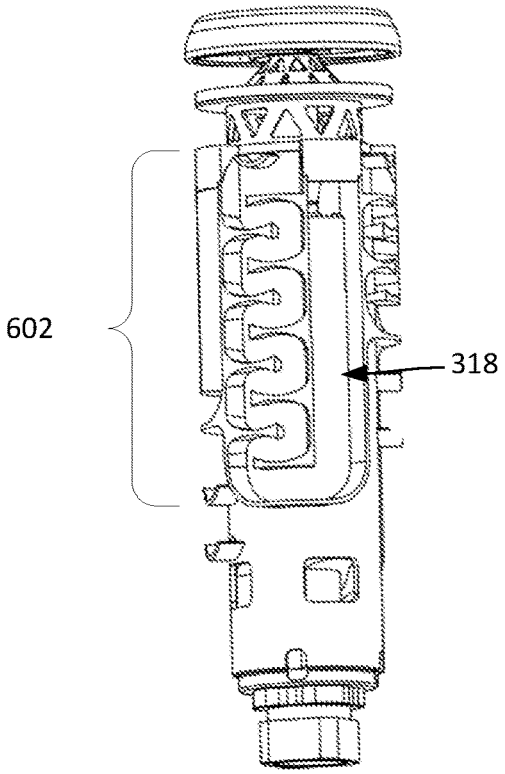
Figure 6D:
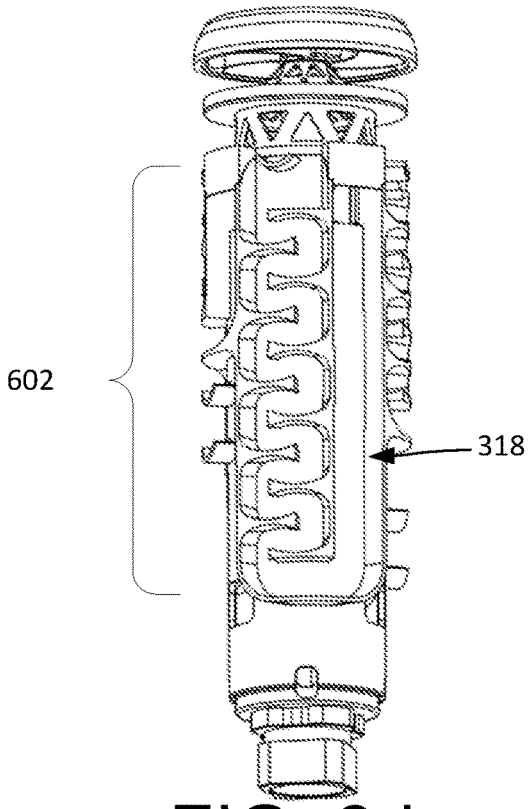

FIG. 5 is a side view diagram of another example of an inner cylinder, in accordance with examples of the subject disclosure. As discussed above, the forward section 318 of the reverse pathway 310 may be formed with different configurations that achieve the effect of off-axis fluid pathways. The forward section 318 may include a pathway having a varying width 502. The varying width 502 of the forward section 318 causes the gasses to alternately increase in speed and pressure and then decrease in speed and pressure. The larger width regions also help create gas expansion pockets that lower pressure. The laminar flow shapes 318 create turbulent flow that slows gasses, helps burn off unburnt propellant and provides additional cooling.

FIGS. **6*a*-6*d* are side view diagrams illustrating a reverse pathway 310, in accordance with examples of the subject disclosure. In certain examples, each reverse pathway 310 occupies a quarter of the circumference of the inner cylinder 204, and accordingly the inner cylinder 204 is configured with four, fluidly independent, reverse pathways 310 disposed around the circumference of the inner cylinder 204. Each of the reverse pathways 310 may have a different longitudinal length than an adjacent reverse pathway 310 as depicted. In other examples, two or more reverse pathways 310 have the same length, but may or may not have differing widths. By having different longitudinal lengths 602, the release of gasses from the suppressor 100 is diffused or spread out due to the amount of time required to for gasses to pass through the different-length pathways. The phrase "longitudinal length" refers to the distance from the end to the point that the reverse section 316 turns into the forward section 318**. Differing widths cause different flow rates and pressures, e.g., a narrowing width increases flow pressure and faster flow rates, while an increasing width will reduce the pressure and slow the flow rate.

The different lengths 602 may be selected according to the specific cartridge, firearm, or application. In other words, the length of the reverse pathways, along with the shape of the baffles or ridges of the off-axis portion, is adjustable to achieve an optimal timing and spread (i.e., amount of gas exiting the end cap across a particular time interval) of gasses. Although depicted and described as 4 reverse pathways 310, it is contemplated that any reasonable number of reverse pathways 310 may be implemented by varying the circumferential distance occupied by each reverse pathway. For example, instead of each reverse pathway occupying approximately ¼ of the circumference, a reverse pathway may occupy $\frac{1}{3}^{rd}$ of the circumference and three total reverse pathways may be implemented.

Figure 7:
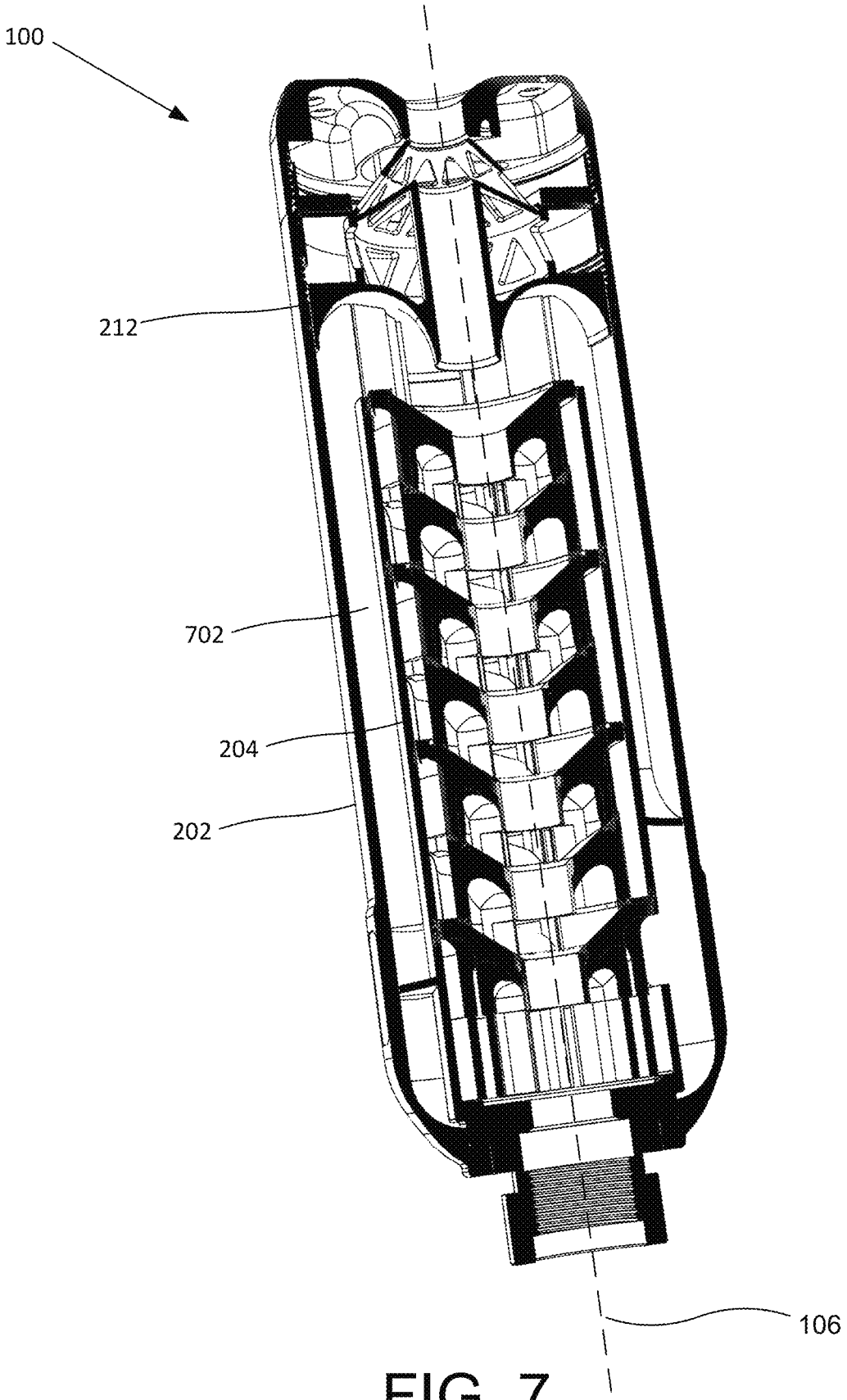
FIG. 7 is a cross-sectional view diagram illustrating one example of the suppressor, in accordance with examples of the subject disclosure.

FIG. 7 is a cross-sectional view diagram illustrating one example of the suppressor 100, in accordance with examples of the subject disclosure. In the depicted example, the bore axis 106 extends from the barrel 112 of the firearm 102 through the suppressor 100. The bore axis 106 depicts the path of a projectile/bullet as it travels through the suppressor 100. As the bullet travels through the suppressor 100, gasses are cooled, slowed and expanded and flow through the various chambers as described above. The reverse pathways are disposed within the chamber 702 formed between the outer cylinder 202 and the inner cylinder 204. Gasses travel through the various directors disposed within the inner cylinder 204 until reaching the reversing baffle 212. The reversing baffle 212 reverses the flow of the gasses into the chamber 702 at which point the gasses flow through one of the reverse pathways (not shown here).

Figure 8:
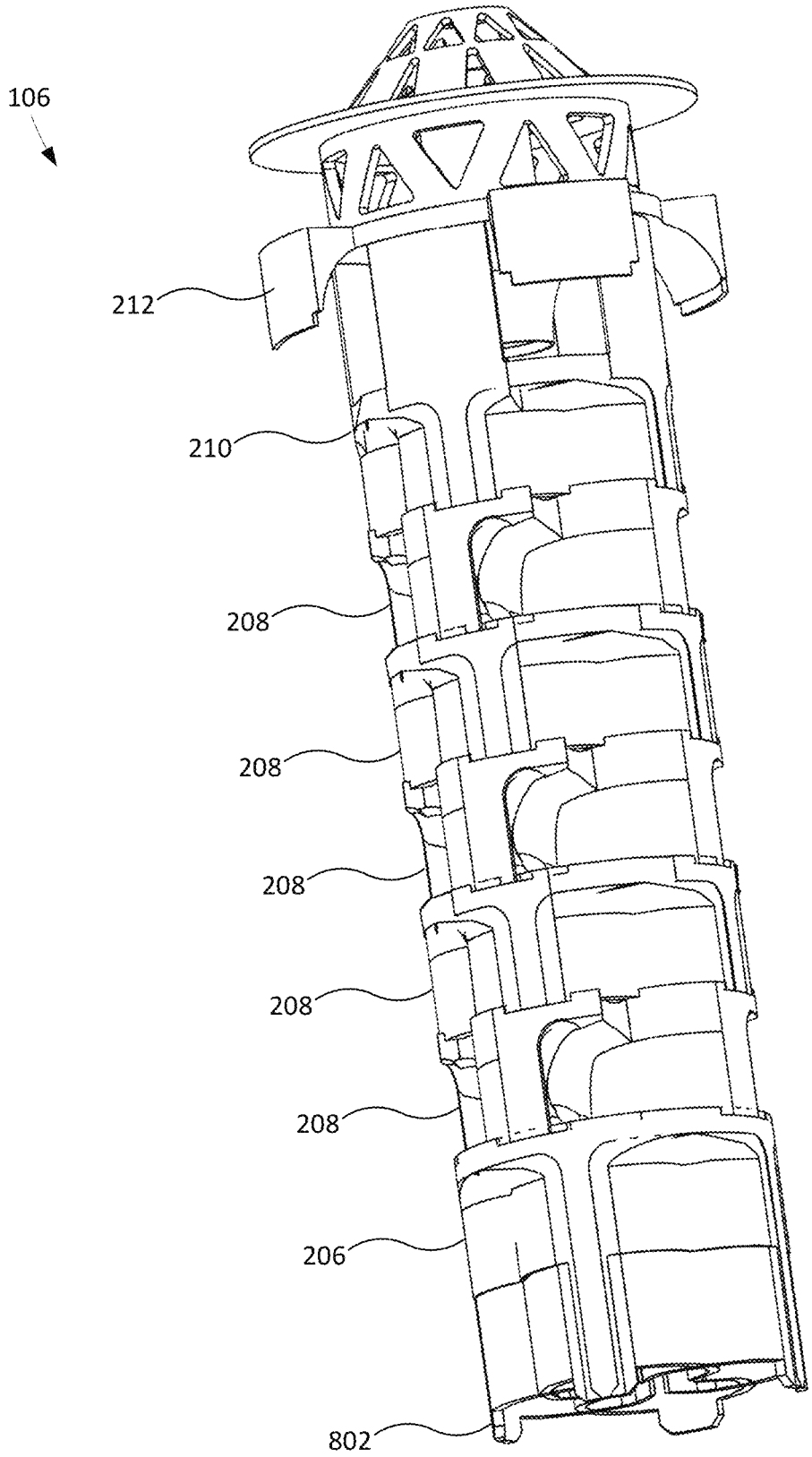
FIG. 8 is a side perspective view diagram illustrating one example of the internal components of the inner cylinder, in accordance with examples of the subject disclosure.

FIG. 8 is a side perspective view diagram illustrating one example of the internal components of the inner cylinder, in accordance with examples of the subject disclosure. The depicted diagram, in particular, illustrates the base flow director 206 with one or more intermediate flow directors 208 stacked on top of the base flow director 206. The end flow director 210 is disposed between the reversing baffle 212 and one of the intermediate flow directors 208. Legs 802 of the base flow director 206 are configured to engage the indexing notches 306 of the inner cylinder 204, as described above with reference to FIG. 3.

Figure 9A:
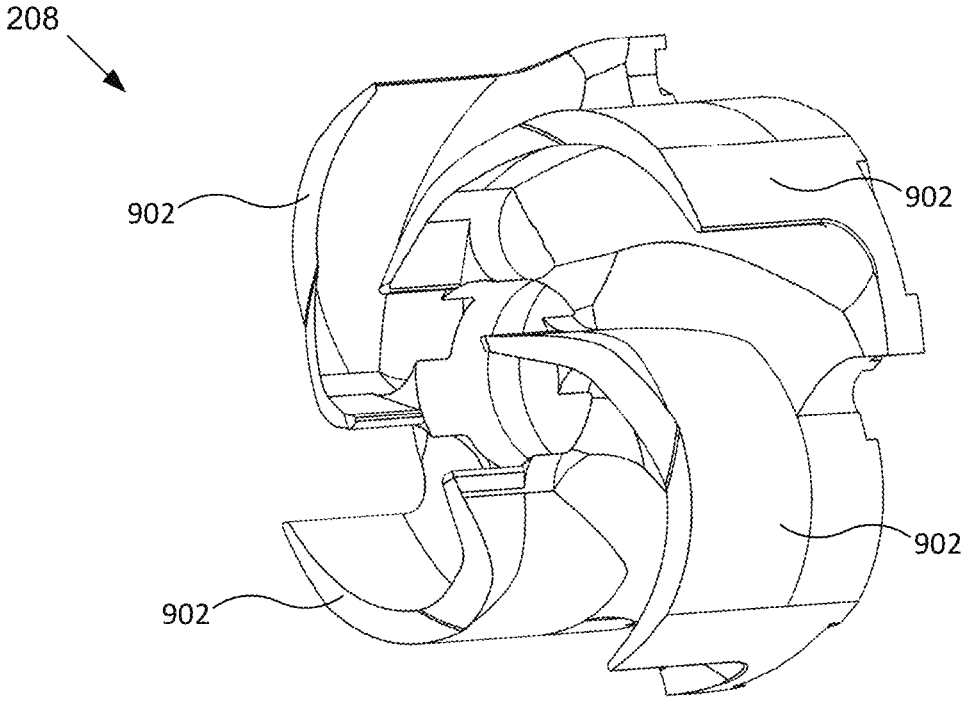
FIGS. 9*a* and 9*b* are a perspective view and a cross-sectional view diagram, respectively, of an intermediate flow director, in accordance with examples of the subject disclosure.
Figure 9B:
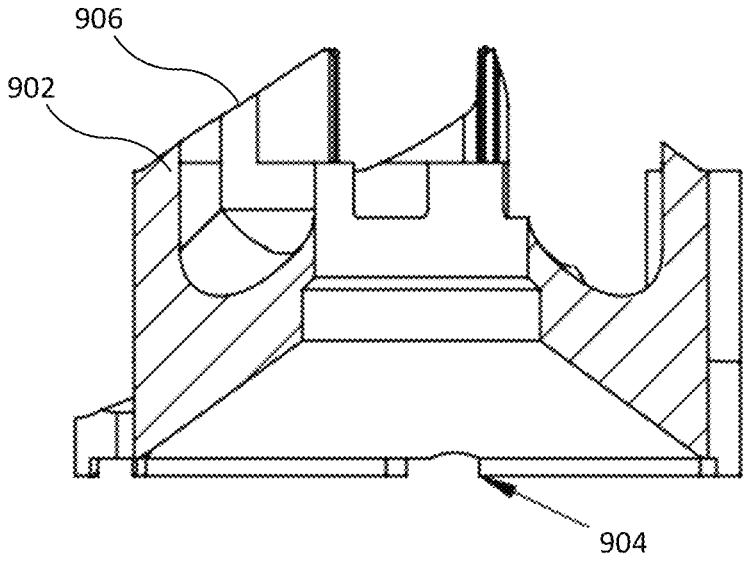

FIGS. 9*a* and 9*b* are a perspective view and a cross-sectional view diagram, respectively, of an intermediate flow director 208, in accordance with examples of the subject disclosure. As described above, intermediate flow directors 208 may be configured with vanes 902 that direct gasses in either a clockwise or counterclockwise direction (the depicted example illustrates the clockwise flow). The intermediate flow directors 208 are stackable, as depicted in FIG. 8. To aid in stacking the directors, each intermediate flow director 208 may be formed with a tapered bottom surface 904 that corresponds with and engages a sloped profile 906 of the vanes of an adjacent intermediate flow director 208.

Figure 10:
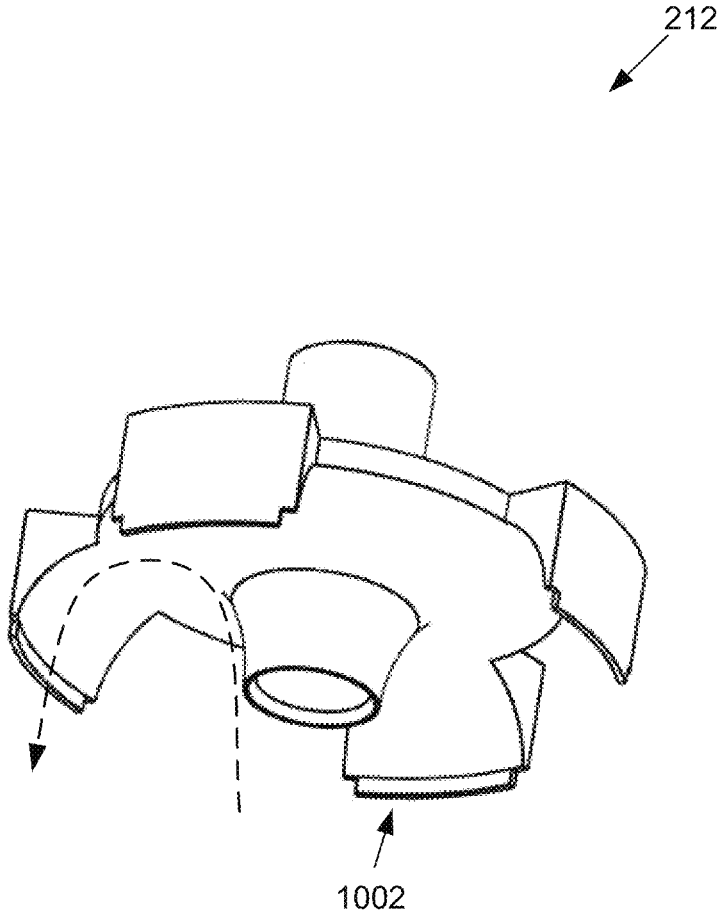
FIG. 10 is a perspective view diagram illustrating one example of the reversing baffle, in accordance with examples of the subject disclosure.

FIG. 10 is a perspective view diagram illustrating one example of the reversing baffle 212, in accordance with examples of the subject disclosure. The reversing baffle 212, in certain examples, includes one or more concave lobes 1002 that correspond with a reverse pathway 310. Each concave lobe 1002 extends from a central region of the reversing baffle 212 outward and is formed of a surface configured to redirect the flow of gasses into the reverse pathway, as depicted by the dashed line. Stated differently, each concave lobe 1002 reverses the flow path of the gasses to be opposite of the original direction. The gasses then flow into one of the reverse pathway 310 which includes flowing through a reverse section 316 and subsequently a forward section 318 before reaching the end cap 220.

In operation, the base flow director 206 seals the gasses in the internal area if the inner cylinder. The base flow director 206 includes a core or bore nipple whose inner wall constitutes a surface area that creates a high-pressure zone between the bullet and inner wall. This element can be used to help reduce pressure blowby. The right and left-hand flow of the intermediate flow directors 208 have a progressive helix and clipped area on the outer diameter. This design moves gasses off the bore axis, helping to reduce blowby and moves the gasses to the outer area of the inner area of the inner cylinder. The progressive helix and clipped areas allow an anterior flow path. Multiple flow paths facilitate less blow by, creates more efficient heat distribution and lowers gas flow pressure and velocity.

When the bullet reaches the end flow director 210, the longer tube of this module creates a much longer-duration higher pressure zone between the inner wall and the bullet. This longer high-pressure zone, when combined with the inside concave laminar flow surfaces of reversing baffle 212 redirects gas into one of the reverse pathways 310.

The reverse pathways 310 flow the gasses back towards the rifle in the outer chamber of the suppressor. The reverse pathways 310 are configured to be of differing lengths, though in certain implementations, they could be of equal lengths. In certain examples, there is a half-circle laminar flow gas turn-around at the mid-point of each pathway. The gasses are then redirected forward through a laminar flow pathway consisting of interdigitated baffles with curved laminar flow shapes on each side. This creates small turbulent flow pockets that help burn off any unburnt propellent and further slow and cool the gasses before exit. It is anticipated that the flow lengths and return path restrictions would be adjusted based on the specific requirements of the cartridge and/or weapon being suppressed as well as intended application, subsonic covert use, etc. The reverse flow segment and forward-exit flow segments of the reverse flow pathways can be equal widths or unequal widths. For example, a wider forward-exit flow segment would lower gas pressure and cause the gasses to slow.

The reverse flow design can redirect a large portion of the gasses that would typically exit with or within a close sequence of the bullet exit and, in the case of shorter suppressors, at higher exit pressures than their longer counterparts and redirect those gasses backwards. This delays the exit, approximating a longer suppressor. Additionally, the different length reverse flow paths and potential of variable flow restriction forces the gasses to exit at different time intervals and at lower pressure, since the redirected gasses were divided into four discrete flow paths, though more or fewer are anticipated. The net result is a shorter suppressor having the sound suppression capabilities of longer suppressors, or potentially exceeding them.

The exit flows from the reverse pathways are vented into the end cap pressure zone and flow through the primary diffuser 214 and the secondary diffuser 216. These modules, combined with the end cap 220, serve to slow and diffuse the gasses, provide additional turbulence and cooling and get a larger portion of those gasses to exit from the anterior vents in the end cap, rather than the typical single exit event out the bore.

The reverse flow design with multiple timed gas exit events allows shorter suppressors to exceed the sound reduction of longer and heavier suppressors while also having lower backpressure, greater thermal efficiency, and excellent flash suppression.

The benefits of the above-described firearm suppressor are many, and include backpressure reduction. The firearm suppressor of the current disclosure reduces the sound signature from firearms resulting from the discharge of the cartridges and the exiting of high pressure, high velocity, hot expanding gasses from the firearms muzzle which displaces ambient air and creates sound signatures typically between 160 and 170 decibels. The firearm suppressor of present disclosure provides a three-dimensional gas flow and opens up the full internal volume of the suppressor for gas expansion and diffusion. The firearm suppressor also acts as a very effective heat sync to transfer heat from the gasses to the suppressor over the entire length.

The benefits also include muzzle flash and first round flash suppression. The current suppressor design effectively extinguishes the flame from the burning gun powder or propellant by creating a high degree of flow turbulence. The design also facilitates the purging of ambient air and oxygen contained in the suppressor by bleeding off the pressure in the backpressure reduction chamber through the use of purge ports that direct some gasses into the core ahead of the bullets travel down the bore. from the blowdown. The firearm suppressor also has flame/flash extinguishing properties incorporated into the primary and secondary diffusers and end cap venting.

The benefits also include reduced back pressure. When used in conjunction with semi-automatic and fully-automatic firearms, back pressure causes a number of negative effects, such as increased cyclic rate, blow back of carbon, debris and hot gasses into the operating system, action and face of the shooter, which system reliability. The lack of a traditional blast baffle and primary chamber just ahead of muzzle, combined with the backpressure reduction chamber and subsequent multiple flow paths in core created by the intermediate flow directors reduces the effects of backpressure and gas blow by that reduces the effectiveness of the suppressor in mitigating sound.

The benefits also include thermal signature and thermal failure reduction. The design facilitates a more even transfer of heat across the entire suppressor and all components and facilitates rapid cooling after firing. This prevents hot spots from occurring which create a greater thermal signature that can give away a soldier or officers position. Also, thermal related failures are the number one cause of suppressor structural failures.

The benefits also include weight reduction. The reverse flow design provides for a longer duration of gas exit with related lower pressures typically achieved through making suppressors longer and heavier. Targeted sound reduction levels can be achieved in lighter and shorter formats.

The benefits also include accuracy, recoil reduction and service life. Traditional suppressor designs, known as "trapping designs," trap most of the gasses in the suppressor structures behind the bullet. In these designs, there is much higher pressure behind the bullet and lower pressure in front of the bullets travel. This creates more gas blow by, where the gasses are compressed between the inner baffle wall and the bullet. The compressed gasses are accelerated, rather than slowed, which creates accelerated erosion of the baffles inner wall. As baffle erode, uneven pressures are created around the bullet which ultimately affect accuracy. In addition, multiple exit events of high pressure gasses accelerated through the bore of the suppressor increases rearward movement of the weapon and suppressor which is transmitted to the shooter as recoil. The "flow core" arrangement of the intermediate flow directors creates an anterior flow path in each inner chamber into the next chamber. This reduces the blow by, reduces the effects of the exit events and the erosion of the suppressor bore. And, facilitates improved slowing and cooling of the gasses, which has other beneficial attributes.

The benefits also include improved water displacement. The firearm suppressor of the current disclosure allows a firearm to be fired with water in the system as the air/gas flow displaces the water, forcing it out of the firearm suppressor, without creating an over-pressure situation that could cause a catastrophic failure. Also, when held pointed down, the current suppressor will drain rapidly in a matter of seconds.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A firearm suppressor comprising:

an outer cylinder defining a longitudinal axis;

an inner cylinder having an inner chamber, where the inner cylinder is disposed at least partially within the outer cylinder and defines an outer chamber with the outer cylinder, where the outer chamber is disposed between an inner surface of the outer cylinder and an outer surface of the inner cylinder;

a coupling mechanism configured to attach the firearm suppressor to a muzzle of a firearm;

a reversing baffle disposed at one end of the inner cylinder that is opposite the coupling mechanism, and configured to reverse a flow of gasses from the inner chamber and direct the gasses into the outer chamber; and at least one reverse flow pathway disposed within the outer chamber and comprising a reverse section and a forward section, and where the at least one reverse flow pathway fluidly couples the inner chamber with an end cap.

2. The firearm suppressor of claim 1, where the at least one reverse flow pathway is defined by the outer surface of the inner cylinder, the inner surface of the outer cylinder, and a plurality of ridges disposed between the outer cylinder and the inner cylinder.

3. The firearm suppressor of claim 2, where the at least one reverse flow pathway comprises at least 4 reverse flow pathways of equal circumferential arc length, and where each of the at least 4 reverse flow pathways has a unique longitudinal length.

4. The firearm suppressor of claim 3, where each of the at least 4 reverse flow pathways is fluidly independent from each other.

5. The firearm suppressor of claim 2, where reverse section is substantially linear and directs the flow of gasses in a direction substantially parallel with a bore axis.

6. The firearm suppressor of claim 2, where the forward section is non-linear and is configured to direct the flow of gasses in at least a first off-axis direction and a second off-axis direction with respect to the bore axis.

7. The firearm suppressor of claim 1, where the inner cylinder is configured to couple with a muzzle of a firearm.

8. The firearm suppressor of claim 1, further comprising a removable flow director disposed within the inner cylinder, where the flow director comprises a plurality of vanes configured to direct the flow of gasses in one of either a clockwise or a counterclockwise direction.

9. The firearm suppressor of claim 8, where the flow director comprises a plurality of flow directors, and where the plurality of flow directors includes at least one flow director having clockwise oriented vanes positioned adjacent a flow director having counterclockwise oriented vanes.

10. The firearm suppressor of claim 1, where the reversing baffle comprises a plurality of lobes having a concave surface configured for redirecting the flow of gasses.

11. A firearm comprising:

a suppressor coupled to a muzzle of the firearm at a coupling mechanism, the suppressor comprising:

an outer cylinder defining a longitudinal axis;

an inner cylinder having an inner chamber, where the inner cylinder is disposed at least partially within the outer cylinder and defines an outer chamber with the outer cylinder, where the outer chamber is disposed between an inner surface of the outer cylinder and an outer surface of the inner cylinder;

a reversing baffle disposed at one end of the inner cylinder that is opposite the coupling mechanism, and configured to reverse a flow of gasses from the inner chamber and direct the gasses into the outer chamber; and at least one reverse flow pathway disposed within the outer chamber and comprising a reverse section and a forward section, and where the at least one reverse flow pathway fluidly couples the inner chamber with an end cap.

12. The firearm of claim 11, where the at least one reverse flow pathway is defined by the outer surface of the inner cylinder, the inner surface of the outer cylinder, and a plurality of ridges disposed between the outer cylinder and the inner cylinder.

13. The firearm of claim 12, where the at least one reverse flow pathway comprises at least 4 reverse flow pathways of equal circumferential arc length, and where each of the at least 4 reverse flow pathways has a unique longitudinal length.

14. The firearm of claim 13, where each of the at least 4 reverse flow pathways is fluidly independent from each other.

15. The firearm of claim 12, where reverse section is substantially linear and directs the flow of gasses in a direction substantially parallel with a bore axis.

16. The firearm of claim 12, where the forward section is non-linear and is configured to direct the flow of gasses in at least a first off-axis direction and a second off-axis direction with respect to the bore axis.

17. The firearm of claim 11, where the inner cylinder is configured to couple with the muzzle of a firearm.

18. The firearm of claim 11, further comprising a removable flow director disposed within the inner cylinder, where the flow director comprises a plurality of vanes configured to direct the flow of gasses in one of either a clockwise or a counterclockwise direction.

19. The firearm of claim 18, where the flow director comprises a plurality of flow directors, and where the plurality of flow directors includes at least one flow director having clockwise oriented vanes positioned adjacent a flow director having counterclockwise oriented vanes.

20. The firearm of claim 11, where the reversing baffle comprises a plurality of lobes having a concave surface configured for redirecting the flow of gasses.

* * * * *